United States Patent [19]

Bohg et al.

[11] 4,425,845

[45] Jan. 17, 1984

[54] BANK FOR ACCOMMODATING SEVERAL PRINT RAM UNITS

[75] Inventors: Armin Bohg, Weil im Schoenbuch; Kurt Hartmann, Calw-Heumaden, both of Fed. Rep. of Germany

[73] Assignee: International Business Machines Corporation, Armonk, N.Y.

[21] Appl. No.: 363,972

[22] Filed: Mar. 31, 1982

[30] Foreign Application Priority Data

Nov. 4, 1981 [DE] Fed. Rep. of Germany ..... 3114835

[51] Int. Cl.[3] ..... B41J 9/30

[52] U.S. Cl. ..... 101/93.34; 101/93.48

[58] Field of Search ..... 101/93.02, 93.03, 93.09, 101/93.29, 93.34, 93.48

[56] References Cited

U.S. PATENT DOCUMENTS

| | | | |
|---|---|---|---|
| Re. 27,175 | 9/1971 | Arnold et al. | 101/93 |
| 162,993 | 5/1875 | Bohg . | |
| 364,091 | 5/1887 | Bohg . | |
| 3,172,352 | 3/1965 | Helms | 101/93.34 |
| 3,490,366 | 1/1970 | Benson et al. | 101/93.33 |
| 3,568,593 | 3/1971 | Papadepoulos | 101/93.34 |
| 3,636,865 | 1/1972 | Konkel et al. | 101/93 C |
| 3,643,595 | 2/1972 | Helms et al. | 101/93.34 |
| 3,919,933 | 11/1975 | Potter | 101/93.32 |
| 3,998,153 | 12/1976 | Erhardt et al. | 101/93.48 |
| 4,014,258 | 3/1977 | Wassermann | 101/93.34 |
| 4,371,857 | 2/1983 | Bohg et al. | 335/259 |
| 4,388,861 | 6/1983 | Bohg et al. | 101/93.02 |

OTHER PUBLICATIONS

IBM TDB, 4/78, pp. 4686–4687.

*Primary Examiner*—Edward M. Coven
*Attorney, Agent, or Firm*—Gregory A. Conley; J. S. Gasper; J. Jancin, Jr.

[57] ABSTRACT

Bank for accommodating adjacent ram units. Each of these consists of a flat, narrow frame. A tongue-shaped ram, driven by an electromagnetic actuator, extends in a recess of the frame. For accommodating and guiding the individual print ram units, the bank is provided with a receiving bar and a comblike holding bar between which the frames are arranged. Extension pieces of the lower frame elements can be accommodated by slits in the receiving bar. The upper frame elements are held in recesses of the comblike holding bar. The tongue-shaped rams are laterally guided by the electromagnetic actuators which are arranged on both sides of the frame and are aligned to each other.

11 Claims, 4 Drawing Figures

FIG. 2
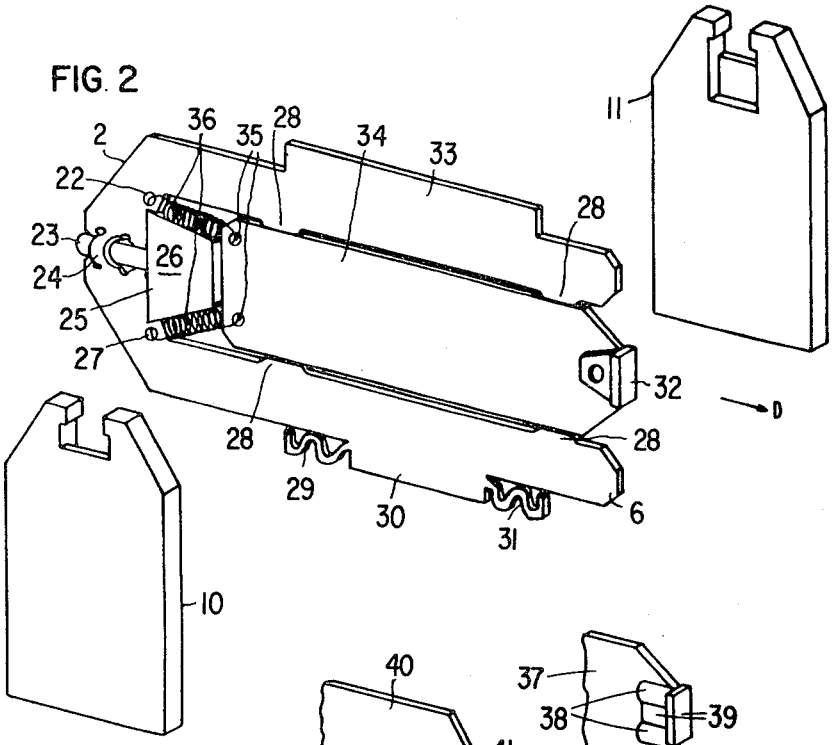
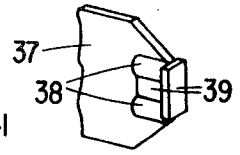
FIG. 3
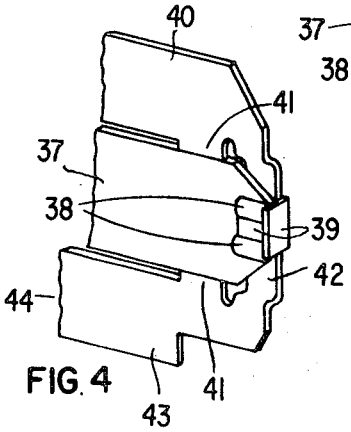
FIG. 4

BANK FOR ACCOMMODATING SEVERAL PRINT RAM UNITS

TECHNICAL FIELD

The invention relates to a bank for accommodating several print ram units comprising a frame and electromagnetic actuators for the print ram arranged in a recess of the frame.

BACKGROUND ART

Relevant print ram actuators are described in U.S. application Ser. No. 162,993, filed June 25, 1980, and U.S. Patent No. 4,371,857. They are intended in particular for use in impact printers.

A plurality of print hammer actuators are also known which operate to different principles.

In accordance with U.S. Pat. No. 27,175, the print hammers are supported by leaf springs, whose energy is stored in their deflected state and used for print hammer actuation. The print hammer is electromagnetically fired by discontinuing the excitation of an electromagnet retaining the print hammer.

Line printers with a plurality of character positions comprise so-called print hammer banks. These print hammer banks serve to accommodate individual print hammer units, each of which is associated with a particular print position. The print hammer bank described in U.S. Pat. No. 27,175 has a number of special features: The preloaded print hammers are held by an electromagnet common to all print hammers. The carrier of the electromagnet is fixed to leaf springs, is shiftable in parallel and performs a reciprocal movement perpendicularly to the print line. This reciprocal movement serves to return the print hammers after actuation. The individual print hammers are also provided with flexibly mounted damping elements. These elements absorb the energy of the returning print hammers and latch the print hammers by means of resilient latches until the magnet yokes of the holding magnet have seized the print hammers in this very forward position. In addition, the damping elements are fixed to a pivotable support spanning the various print positions and whose pivot point is staggered in a downward direction relative to the resilient latches. By means of a cam type drive, the support can be provided for a short time to release the print hammers.

In a typical high-speed impact printer, such as IBM printer Model 3203, each print hammer unit consists of a clapper magnet, a separate print hammer and a push rod for transferring the kinetic energy of the clapper armature to the print hammer. By means of two screws, each electromagnet is screwed to a base plate common to all print units. Each time the flight time is adjusted, these screws have to be loosened and subsequently retightened. Each electromagnet fully transfers the recoil occurring during the acceleration of the armature to the base plate. It is not possible to exchange individual print hammers.

In addition, U.S. Pat. No. 4,388,861 describes a bank for accommodating several print ram units, which meets the following requirements:

each print ram unit is individually exchangeable without diassembling the bank;

the full recoil pulse is not transferred to the bank; and few fixing elements are required for assembling the various print ram units.

The print ram units of this bank consist of a flat, narrow frame. In a recess of the frame an electromagnetic actuator is positioned for a ram guided in two bores of the frame. For accommodating and guiding the individual ram units, the bank has an essentially U-shaped cross-section. At least on one of its two ends, the frame of each ram unit is provided with a flexible pin arranged between two frame arms. The frames are detachably mounted between the U-arms of the bank. Both U-arms have recesses for positively or frictionally accommodating the front or rear frame part and the pin, respectively.

This bank described in the U.S. Pat. No. 4,388,861 above is particularly suitable for cylindrical print rams according to U.S. Pat. No. 4,371,857.

DISCLOSURE OF THE INVENTION

It is the object of the present invention to provide a bank for accommodating print ram units with a tongue-shaped print ram.

Such tongue-shaped print rams are described, for example, in the Application Ser. No. 162,993 previously mentioned.

This bank is to meet the following requirements:

Space-saving arrangement of the print ram units, preferably in a raster of 1/10".

Use of only a few fixing elements.

Exchangeability of individual print ram units.

Print ram units mounted in such a manner that there are either no recoil forces or that recoil forces, if any, are damped.

Low-cost production.

The preferred embodiment of the invention is shown in the drawings and will be described in detail below.

BRIEF DESCRIPTION OF THE DRAWING

FIG. 2 is a simplified perspective exploded representation of a print ram unit with its associated electromagnetic actuators for the tongue-shaped ram, which are arranged on both sides of its frame.

FIG. 3 is a perspective partial representation of a tongue-shaped print ram with a print hammer fixed by means of injection-molded plastic.

FIG. 4 is a simplified perspective partial representation of a frame of a print ram unit with a lateral guide bar for the print ram.

BEST MODE FOR CARRYING OUT THE INVENTION

Figure 1:
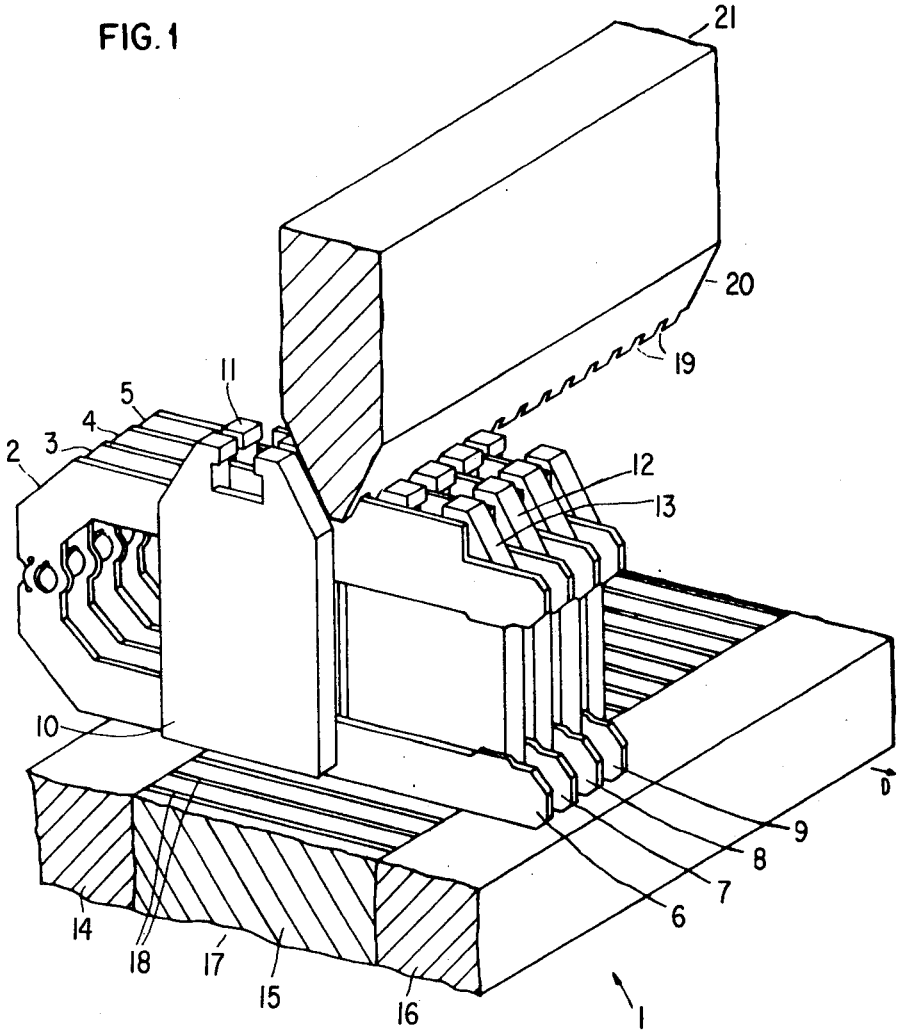
FIG. 1 is a perspective view of a bank for accommodating several print ram units.

FIG. 1 is a perspective view of a bank for accommodating several print ram units. The print ram units, of which for the sake of simplicity only four units (without the print rams) are shown, are designated as 2, 3, 4 and 5. The frames of these print rams units are designated as 6, 7, 8 and 9. Each print ram unit is associated with a pair of electromagnetic actuators for the print ram. the electromagnetic actuators for the print ram unit 2 are designated as 10 and 11 and are arranged in alignment to each other on both sides of the frame 6.

Electromagnetic actuators as may be used for the bank described here are covered by Application Ser. No. 162,993 above.

The representation of FIG. 1 shows how the individual print ram units are accommodated in the print hammer bank. The print hammer bank consists of a lower part 17 and a comblike upper part 21. The lower part 17 is referred to below as the base part and the upper part 21 as the comb part. The base part is made up of two bars 14, 16 extending parallel to each other and a part 15 arranged therebetween with slits 18. The slits extend parallel to each other and are longitudinally limited by the bars 14 and 16. They each serve to accommodate one lower extension piece (see FIG. 2 and FIG. 4) of the print ram frames.

The comb part 21 of the bank consists of a sloped part 20 which is provided with comblike recesses 19. These comblike recesses 19 are aligned to the slits 18 in the base part 17. Each of these comblike recesses 19 embraces a part of the upper end of the frame of the individual print ram units. Thus, the individual print ram units are held in place. Lateral displacement is prevented by the slits 18 and the comblike recesses 19, respectively; vertical displacement is prevented by the position of the print ram units between the base part 17 and the comb part 21, whereas displacement in the operating direction of the print ram (not shown) parallel to the direction of the slits 18 and opposite thereto, respectively, is prevented or can be influenced, as desired, by suitably accommodating the lower frame extension (30, 43) in the slits 18. This is particularly important for damping the recoil of the ram on the print hammer bank. Further details on this will be provided in connection with FIG. 2.

It has already been mentioned, for example, that on either side of the frame 6 of the print ram unit 2, there is one electromagnetic actuator 10 which is aligned to another actuator 11. To ensure that the print rams in the bank are densely packed, the electromagnetic actuators of adjacent print ram units are staggered in pairs, so that the spacing of two adjacent frames is determined by the thickness of one electromagnetic actuator. As may be seen from FIG. 1, the electromagnetic actuators 10 and 11 of the print ram unit 2 are staggered relative to the electromagnetic actuators 13 and 12 the print ram unit 3.

For the sake of clarity, the electromagnetic actuators for the print ram unit 4 are not shown in FIG. 1.

FIG. 2 is an exploded representation showing a print ram unit with a print ram in a perspective and simplified form.

The ram unit is designated as 2. It consists of a frame 6, a tongue-shaped print ram 34 to whose operating end a ram head 32 is attached, and of electromagnetic actuators for the ram which are arranged on both sides of the frame. The operating principle of such a ram actuator is described in the Application Ser. No. 162,993 above so that it need not be repeated at this point. For the same reason, details of this operating principle have been omitted for the print ram 34 and the electromagnetic actuators 10 and 11. Embodiments of the electromgagnets and of the relevant actuator parts in the tongue 34 are described in the German Patent Application No. P 31 14 834.4 filed simultaneously with German Patent Application No. P 31 14 835.2, of which the present application is the U.S. counterpart.

The frame 6 is essentially U-shaped. The tongue-shaped ram 34 with the ram head 32 designated as a print hammer is positioned in the recess between the two frame arms. This print ram is capable of moving in the direction of print D marked by the arrow (or in a direction opposite thereto); its movement in a vertical direction is limited by the frame extensions 28; lateral displacement is prevented by the electromagnetic actuators 10 and 11 fixed to frame 6. The electromagnetic actuators may be attached to the frame by gluing, screwing, riveting or other conventional methods. At the rear end of the tongue-shaped ram 34 there are two bores 35; the rear base part of the U-shaped frame is also provided with two bores 27. Each of these bores 35 and 27 accommodates one tension spring 36. After actuation, the print ram 34 is returned to its starting position by means of these tension springs.

In the embodiment according to FIG. 2 the starting position is formed by a trapezoidal stop 25. A pin-shaped extension 23 of the stop 25 is clamped in a recess 24 of the frame. By activating the electromagnetic actuators, the ram is moved in the operating direction (arrow D). After impact (on the print type, not shown, or a record carrier, not shown), the print ram is returned to its starting position by the tension of the springs 36. It is advantageous for this process if the tension springs 36 are arranged on the sloped faces of the trapezoidal stop 25 whose slope is opposite to the direction D and whose resonant oscillations are damped when the stop 25 is contacted. The print ram may also be returned to its starting position by a cylindrical damper (not shown) which is screwed into a threaded sleeve arranged in the direction of print in a crimp joint at the base of the U-shaped frame.

It has already been pointed out that the individual print ram units are inserted with the lower (flag-shaped) extension piece 30 of the frame 6 into a slit 18 of the base part 17. To prevent the recoil occurring when the print ram is fired or returned to its starting position from being transferred in full to the print hammer bank, the outer ends of the flag-shaped extension 30 may be designed as springs. The free ends of these springs 31 and 29 are stopped by the bars 14 and 16. Recoil forces in or opposite to the direction of print D are partly absorbed by these springs, while the print ram unit is slightly shifted in slit 18. During this, the recoil is damped and not transferred in full to the bank.

Apart from the possibility of damping the recoil by means of the spring elements 31 and 29, respectively, shown in FIG. 2, other solutions are equally conceivable. Thus, it is possible, for example, for the flag-shaped extension to be only rectangularly shaped (without springs 31 and 29) at its ends and for the springs to be replaced by inserts of elastic material, for example, rubber, extending across the whole print hammer bank in the base part. Recoil damping may also be effected at the end of the frame remote from printing by having the frame act on a resilient or damping stop.

It has already been mentioned that the tongue-shaped print ram 34 is vertically guided by the frame element extensions 28 and laterally by the electromagnetic actuators 10 and 11.

To improve the lateral guidance, in particular of the front part of the print ram, a guide bar may be provided. As may be seen from FIG. 4, the guide bar 42 extends from the front part of the upper frame arm 40 to the front part of the lower frame arm 44. The plane of the guide bar 42 extends parallel to the main plane of the frame. The mutual stagger of both planes is chosen so that the guide bar 42 forms a lateral guide for one side of the ram head 39. For adjacent print ram units in the bank the guide bars are designed in such a manner that a ram head is guided both by the inside of the guide bar of the frame with which it is associated and by the outside of the guide bar of its adjacent frame.

In FIG. 4 the frame extensions for vertically guiding the print ram 37 are designated as 41, the flag-shaped extension being rectangularly designed and designated as 43.

The ram head 39 may be fixed to the print ram in a plurality of different ways, using conventional methods, such as gluing, riveting, etc. It is particularly simple and advantageous for the ram head 39 to have an essentially T-shaped profile, to be inserted into a suitable recess of the ram tongue 37 and for the insertion rims to be fully or partly injection-molded with a plastic 38 (FIG. 3).

While the present invention has been particularly described with reference to the preferred embodiment thereof, it will be understood by those skilled in the art that various changes in form and detail may be made therein, without departing from the spirit and scope of the invention as illustrated in the appended claims.

We claim:

1. A bank for accommodating at least one print ram unit comprising:

at least one frame having a lower extension piece, an upper extension piece and a first recess lying between said lower extension piece and said upper extension piece;

at least one pair of electromagnetic ram actuators, one of said pair of actuators located on one side of said frame and the other of said pair of actuators located on the opposite side of said frame;

a base part having slits therein to accommodate the lower extension piece of said frame;

a comb part having at least one recess therein to accommodate said upper extension piece of said frame;

at least one print ram arranged in said first recess and operated by said at least one pair of actuators;

a ram head coupled to said print ram for serving as a print hammer; and a spring means coupled to said lower extension piece for reducing the recoil force on said frame when said print ram is operated;

whereby said frame is arranged between said base part and said comb part.

2. A bank according to claim 1 wherein said lower extension piece is flag-shaped.

3. A bank according to claim 1, said base part additionally comprising:

two stops, one of said stops on an end of said base part which is perpendicular to said slits and the other of said stops on the opposite end of said base part; and the ends of said lower extension piece being resilient in the direction of said slits;

whereby the length of said slits are limited by said two stops.

4. A bank according to claim 3 additionally comprising:

a guide bar coupled to said lower extension piece, said upper extension piece and said print ram for laterally guiding said print ram.

5. A bank according to claim 1 wherein said print ram is a flat tongue-shaped element laterally guided by said pair of actuators and vertically guided by said lower extension piece and said upper extension piece.

6. A bank according to claim 1 additionally comprising a guide bar coupled to said lower extension piece, said upper extension piece and said print ram for laterally guiding said print ram.

7. A bank according to claim 1 wherein said lower extension piece is rectangularly shaped.

8. A bank according to claim 1 wherein said pair of actuators are arranged in an aligned manner and connected to said frame.

9. A bank according to claim 1 additionally comprising:

tension springs, said springs coupling said print ram to said frame;

whereby said print ram is returned to a starting position by said tension springs after said print ram is operated.

10. A bank according to claim 1 wherein said pair of actuators associated with adjacent print ram units are alternately staggered relative to each other to obtain small spacings between adjacent print ram units.

11. A bank according to claim 1 additionally comprising at least one resilient stop arranged in said first recess, whereby said print ram contacts said resilient stop when said print ram is in a starting position.

* * * * *

UNITED STATES PATENT AND TRADEMARK OFFICE

CERTIFICATE OF CORRECTION

PATENT NO. : 4,425,845

DATED : January 17, 1984

INVENTOR(S) : Armin Bohg and Kurt Hartmann

It is certified that error appears in the above—identified patent and that said Letters Patent is hereby corrected as shown below:

Column 1, line 18, after "U.S." insert -- Reissue --;

Column 1, line 29, after "U.S." insert -- Reissue --.

Signed and Sealed this

*Eleventh* Day of *September 1984*

[SEAL]

*Attest:*

GERALD J. MOSSINGHOFF

*Attesting Officer*

*Commissioner of Patents and Trademarks*